US009811047B2

(12) United States Patent
Hayamizu

(10) Patent No.: US 9,811,047 B2
(45) Date of Patent: Nov. 7, 2017

(54) STATIC ELIMINATING DEVICE THAT ELIMINATES SURFACE OF PHOTOSENSITIVE BODY AND IMAGE FORMING APPARATUS INCLUDING THE SAME

(71) Applicant: KYOCERA Document Solutions Inc., Osaka (JP)

(72) Inventor: Hitoshi Hayamizu, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/278,480

(22) Filed: Sep. 28, 2016

(65) Prior Publication Data

US 2017/0090397 A1 Mar. 30, 2017

(30) Foreign Application Priority Data

Sep. 30, 2015 (JP) ..... 2015-194376

(51) Int. Cl.
*G03G 21/08* (2006.01)
*G03G 21/06* (2006.01)

(52) U.S. Cl.
CPC ..... *G03G 21/08* (2013.01); *G03G 21/06* (2013.01)

(58) Field of Classification Search
CPC ..... G03G 15/80; G03G 21/00; G03G 21/08; G03G 21/06
See application file for complete search history.

(56) References Cited

U.S. PATENT DOCUMENTS

2016/0124372 A1* 5/2016 Takagami ..... G03G 21/0094 399/96
2016/0306316 A1* 10/2016 Saito ..... G03G 21/0011

FOREIGN PATENT DOCUMENTS

| | | | | |
|---|---|---|---|---|
| JP | 2004-191790 | A | | 7/2004 |
| JP | 2007219117 | A | * | 8/2007 |
| JP | 2007-264167 | A | | 10/2007 |
| JP | 2013-197742 | A | | 9/2013 |
| JP | 2015068870 | A | * | 4/2015 |

* cited by examiner

*Primary Examiner* — Sevan A Aydin
(74) *Attorney, Agent, or Firm* — IP Business Solutions, LLC

(57) ABSTRACT

A static eliminating device includes a substrate provided with a plurality of light emitters that irradiates light as static eliminating light onto a surface of a photosensitive body, and a plurality of limiting resistors that is provided on a same surface as the light emitters. One ends of each of the plurality of light emitters are connected to a power source via the plurality of limiting resistors. The static eliminating device further includes: a first switching section that supplies power from the power source to the plurality of limiting resistors and the plurality of light emitters at a ON state; and a second switching section that supplies power from the power source to the limiting resistors at the ON state, but does not supply the power to the light emitters.

5 Claims, 5 Drawing Sheets

Fig.5

| STATE OF IMAGE FORMING APPARATUS | HEATER-ON SIGNAL | ERASER SIGNAL | | STATE OF LED |
|---|---|---|---|---|
| READY-TO-PRINT/ PRINTING MODE | LOW | WHEN STATIC ELIMINATION IS NECESSARY | HIGH | ON |
| | | WHEN STATIC ELIMINATION IS UNNECESSARY | LOW | OFF |
| OFF/SLEEP MODE | HIGH | HIGH | | OFF |

STATIC ELIMINATING DEVICE THAT ELIMINATES SURFACE OF PHOTOSENSITIVE BODY AND IMAGE FORMING APPARATUS INCLUDING THE SAME

INCORPORATION BY REFERENCE

This application claims priority to Japanese Patent Application No. 2015-194376 filed on Sep. 30, 2015, the entire contents of which are incorporated by reference herein.

BACKGROUND

The present disclosure relates to a static eliminating device and an image forming apparatus.

Image forming apparatuses based on electrophotographic method are widely known. The method includes five processes, namely uniformly charging an uncharged photosensitive body (charging process), irradiating a charged surface of the photosensitive body with a laser beam according to a document to be copied thereby forming a latent image of the document (exposure process), visualizing the latent image with a toner (developing process), transferring the visualized toner image onto a transfer belt, and further transferring the visualized toner image onto a recording medium such as a sheet from the transfer belt (transfer process), and fixing the transferred toner image onto the recording medium (fixing process).

In the image forming apparatuses with the mentioned method, in order to eliminate unnecessary charge, a technique of arranging, on an opposing position of the photosensitive body, a light emitting diode (LED) substrate that irradiates light and eliminates static electricity from the surface of the photosensitive body is widely known.

If an image forming operation is carried out under highly humid condition, a phenomenon called image flow occurs, and there is a risk of deteriorating a print quality. One of the causes for such phenomenon is dew condensation on the surface of the photosensitive body, which leads faulty electrification and causes the image flow on formed latent images.

SUMMARY

A technique improved over the aforementioned technique is proposed as one aspect of the present disclosure.

A static eliminating device according to an aspect of the present disclosure includes a substrate, a first switching section, a second switching section, and a controller.

The substrate is provided with a light emitter and a limiting resistor. The light emitter is arranged at an opposing position of a surface of a photosensitive body and irradiates static eliminating light for eliminating the surface of the photosensitive body. The limiting resistor is provided on the same surface as the light emitter and is resistance for the light emitter. One end of the light emitter is connected to a power source via the limiting resistor.

The first switching section is provided at a position from the limiting resistor and the light emitter, which are connected in series, to the power source, and connects the power source to the limiting resistor and the light emitter at an ON state, and disconnects the power source from the limiting resistor and the light emitter at an OFF state.

The second switching section is provided at a position from the limiting resistor to the power source, which are connected in series, and connects the power source to the limiting resistor at the ON state, and disconnects the power source from the limiting resistor at the OFF state.

The controller controls ON/OFF operations of the first and the second switching sections.

In addition, the light emitter is branched from a position between the limiting resistor and the power source connected in series, and is serially connected to the limiting resistor. The first switching section is provided at a position from the light emitter and the power source.

When driving the light emitter, the controller switches the first switching section to the ON state and switches the second switching section to the OFF state, and when heating the surface of the photosensitive body, the controller switches the first switching section to the OFF state and switches the second switching section to the ON state.

BRIEF DESCRIPTION OF THE DRAWINGS

FIG. 5 is a table showing relation between signals applied to a transistor and lighting state of a chip light emitting diode.

DETAILED DESCRIPTION

Figure 1:
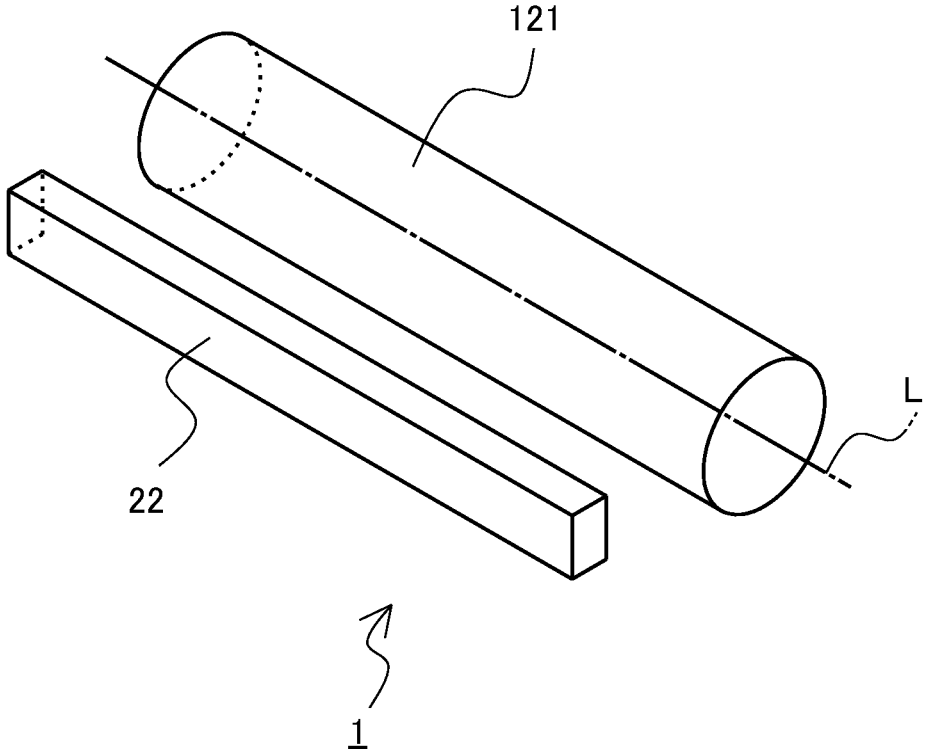
FIG. 1 is a perspective view schematically showing a static eliminating device and peripheral components of an image forming apparatus according to an embodiment of the present disclosure.

Hereinafter, a description will be given of one embodiment of a static eliminating device and an image forming apparatus including the same according to the present disclosure with reference to the drawings. FIG. 1 is a schematic perspective view showing the static eliminating device and peripheral components of the image forming apparatus according to the embodiment of the present disclosure.

The image forming apparatus 1 according to the embodiment of the disclosure is a multifunction peripheral having a plurality of functions, such as copying, printing, scanning, and facsimile transmission. A drum-shaped photosensitive body 121 forms a tonner image on the surface thereof and transfers the formed toner image on a recording medium.

A substrate 22 that constitutes an electronic circuit included in the static eliminating device expends toward longitudinal direction (direction of a rotation axis) of the photosensitive body 121. The substrate 22 is arranged at a position opposed to a surface of the photosensitive body 121. The substrate 22 is arranged parallel to an axis line L of the rotation axis of the photosensitive body 121, and irradiates eliminating light onto the surface of the photosensitive body 121 to eliminate residual charge from the surface of the photosensitive body 121. Furthermore, the substrate 22 in the present embodiment warms the surface of the photosensitive body for dehumidification.

Figure 2:
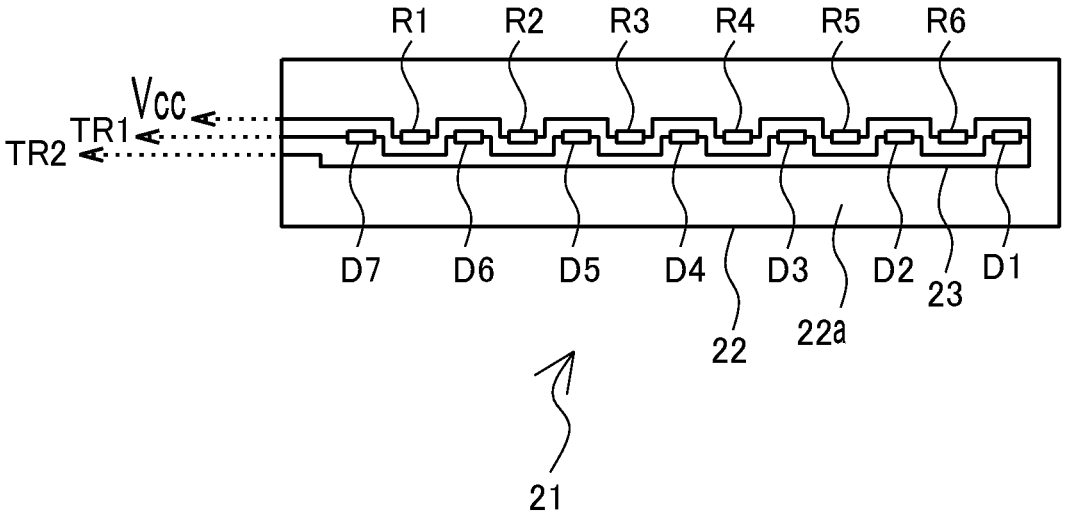
FIG. 2 is a schematic view showing an example of a substrate of the static eliminating device.
Figure 3:
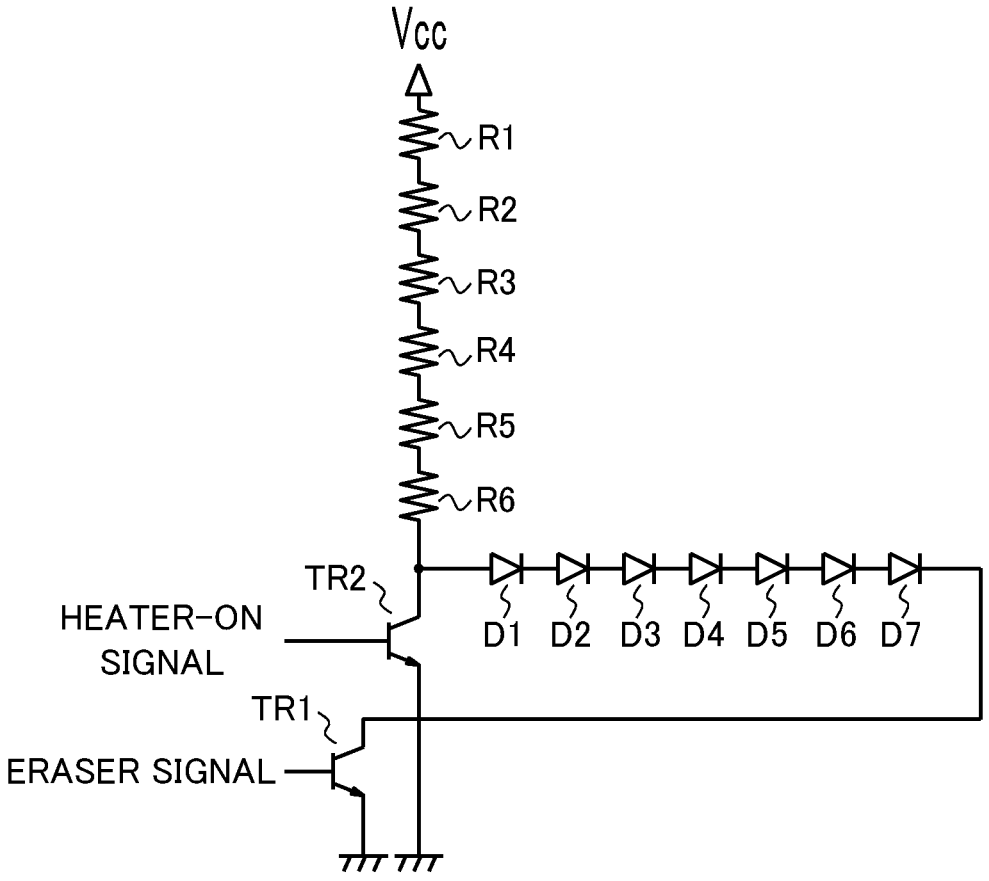
FIG. 3 is a schematic circuit diagram showing an example of the static eliminating device.

FIG. 2 is a schematic view showing an example of the substrate of the static eliminating device, and FIG. 3 is a schematic circuit diagram showing an example of the static eliminating device. The static eliminating device 21 is made up to include the substrate 22 that constitutes the electronic circuit. On a surface 22*a* of the substrate 22 (the surface opposed to the surface of the photosensitive body 121), a plurality of chip light emitting diodes (LEDs) D1 to D7, which are light emitters, are arranged at equal intervals along the longitudinal direction in a line. The plurality of chip light emitting diodes D1 to D7 are connected to each other in series by a conductor pattern 23 formed with a thin copper foil.

Additionally, on the surface 22*a* of the substrate 22 (the same surface as the chip light emitting diodes D1 to D7), a plurality of chip resistors R1 to R6 each serving as a limiting resistor for the chip light emitting diodes D1 to D7 is arranged at equal intervals along the longitudinal direction in a line. The plurality of chip resistors R1 to R6 are also connected to each other in series by the conductor pattern 23.

One end of the chip resistor R1 is connected to a power source Vcc of 24 volt, and the other end thereof is connected to the chip resistor R2. One end of the chip resistor R6 is connected to the chip resistor R5 and the other end thereof is connected to an anode side of the chip light emitting diode D1.

A cathode side of the chip light emitting diode D7 is grounded via a transistor TR1 serving as a switch for static elimination, and a connecting point between the chip resistor R6 and the chip light emitting diode D1 is grounded via a transistor TR2 serving as a switch for dehumidification.

A controller to be subsequently described controls ON/OFF operations of the transistors TR1 and TR2. In accordance with a direction from the controller, a high signal or a low signal is applied to bases of the transistors TR1 and TR2. Here, the chip light emitting diodes D1 to D7, the chip resistors R1 to R6, the transistor TR1, and the transistor TR2 respectively exemplify the light emitter, the limiting resistor, the first switching section, and the second switching section in the disclosure.

As shown in FIG. 3, the transistor TR1 is provided at a position from the chip resistors R1 to R6 and the chip light emitting diodes D1 to D7, which are connected in series, to the power source Vcc. The transistor TR1 connects the power source Vcc to the chip resistors R1 to R6 and the chip light emitting diodes D1 to D7 at an ON state, and disconnects the power source Vcc from the chip resistors R1 to R6 and the chip light emitting diodes D1 to D7 at an OFF state.

The transistor TR2 is provided at a position from the chip resistors R1 to R6 to the power source Vcc, which are connected in series. The transistor TR2 connects the power source Vcc to the chip resistors R1 to R6 at the ON state, and disconnects the power source Vcc from the chip resistors R1 to R6 at the OFF state.

Figure 4:
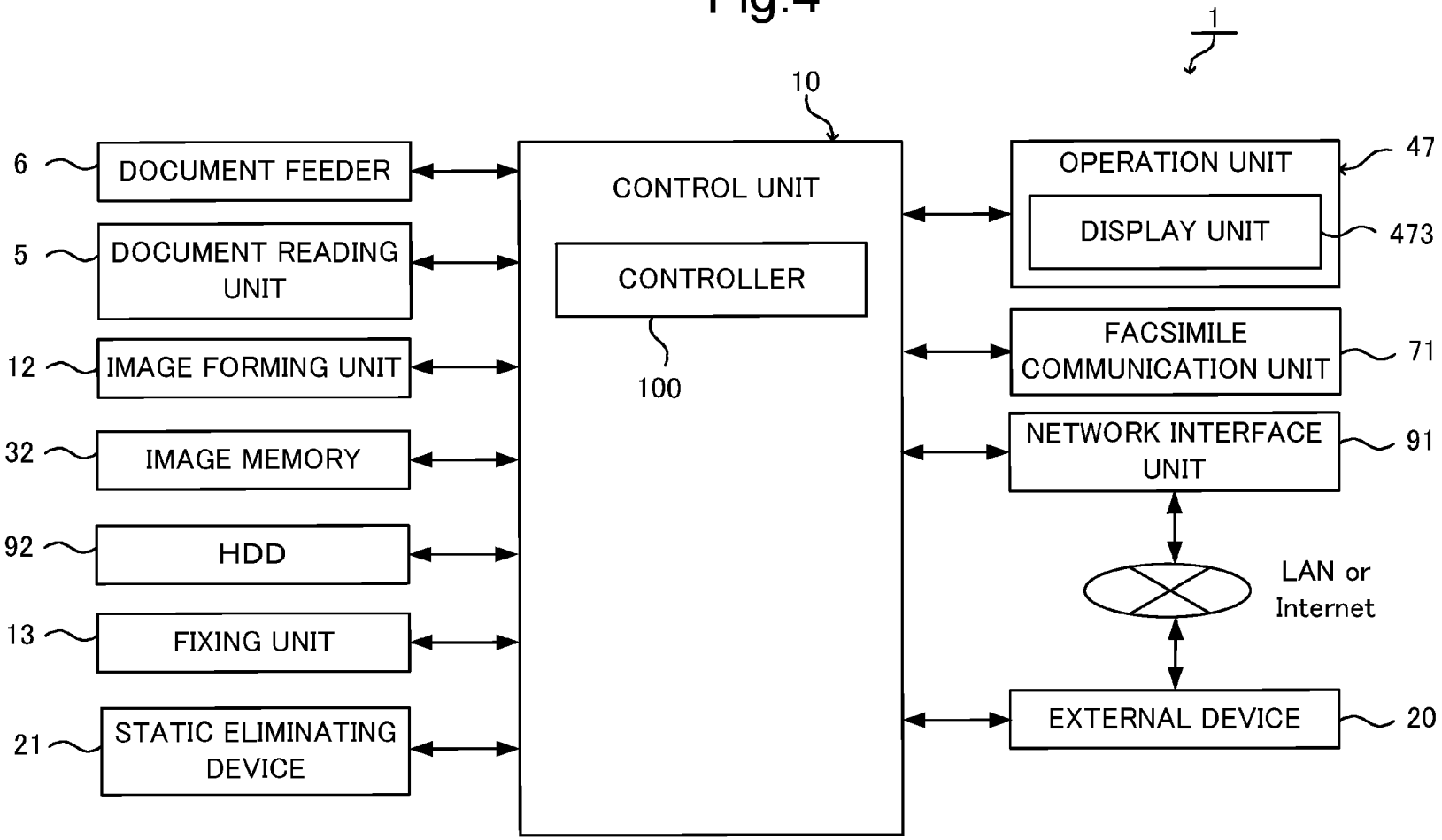
FIG. 4 is a functional block diagram schematically showing an essential part of an internal configuration of the image forming apparatus according to the embodiment of the present disclosure.

FIG. 4 is a functional block diagram schematically showing an essential part of the internal configuration of the image forming apparatus 1. The image forming apparatus 1 is made up by including a control unit 10, a document feeder 6, a document reading unit 5, an image forming unit 12, an image memory 32, a hard disk drive (HDD) 92, a fixing unit 13, a static eliminating device 21, an operation unit 47, a facsimile communication unit 71, and a network interface unit 91.

The document feeder 6 feeds a document to be read to the document reading unit 5.

The document reading unit 5 includes an unillustrated reading mechanism including a light emitting unit and a charge coupled device (CCD) sensor, to be controlled by the controller 100 comprising the control unit 10. The document reading unit 5 illuminates a source document with the light from the light emitting unit and detects the reflected light with the CCD sensor, to thereby read the image on the source document.

The image forming unit 12 includes the drum-shaped photosensitive body 121 and forms a toner image to be printed onto a paper sheet. For example, the image forming unit 12 includes the photosensitive body 121, a charging device, a laser scanning unit (LSU), a developing device, a primary transfer roller, and a secondary transfer roller. The photosensitive body 121 forms an electrostatic latent image on a circumferential surface thereof and a toner image along the electrostatic latent image. The charging device uniformly charges the circumferential surface of photosensitive body 121. The exposure device is a so-called laser exposure device which irradiates laser light corresponding to each color based on image data to the circumferential surface of the charged photosensitive body 121 to form the electrostatic latent image on the circumferential surface of the photosensitive body 121. The developing device supplies toner to the electrostatic latent image on the circumferential surface of the photosensitive body 121 to form the toner image onto the circumferential surface of the photosensitive body 121 in association with the image data. The toner image is transferred by the primary transfer roller from the photosensitive body 121 to the intermediate transfer belt, and further transferred from the intermediate transfer belt to the recording paper sheet by the secondary transfer roller.

The image memory 32 is a region for temporarily storing the image data of the source document acquired by the document reading unit 5, and temporarily saving data to be printed by the image forming unit 12.

The HDD 92 is a large-capacity storage device for storing source images acquired by the document reading unit 5, and so forth.

The fixing unit 13 fixes the toner image on the sheet by thermocompression to the sheet.

The static eliminating device 21 irradiates eliminating light onto the surface of the photosensitive body 121 to eliminate the residual charge from the surface of the photosensitive body 121, and also warms the surface of the photosensitive body 121 and dehumidifies.

The operation unit 47 receives instructions from an operator, for operations and processing that the image forming apparatus 1 is capable of performing, such as image forming and document reading. The operation unit 47 includes a display unit 473 for displaying guidance and so forth to the operator. The display unit 473 is a touch panel with which the operator can control the image forming apparatus 1 by touching buttons and keys displayed thereon.

The facsimile communication unit 71 includes an encoding/decoding unit, a modem, and a network control unit (NCU), which are all unillustrated, to perform facsimile transmission through a public circuit.

The network interface unit 91 includes a communication module such as a local area network (LAN) board, to transmit and receive data to and from an external device 20 such as a personal computer in the local area or in the Internet, through the LAN connected to the network interface unit 91.

The control unit 10 includes a central processing unit (CPU), a random access memory (RAM), a read only memory (ROM), and an exclusive hardware circuit. The control unit 10 includes the controller 100 that serves to control the overall operation of the image forming apparatus 1.

The control unit 10 acts as the controller 100 by operating in accordance with a control program installed in the HDD 92. However, the controller 100 may be constituted of hardware circuits instead of the operation by the control unit 10 in accordance with the control program. This also applies to other embodiments, unless otherwise specifically noted.

The controller 100 is connected to the document feeder 6, the document reading unit 5, the image forming unit 12, the image memory 32, the HDD 92, the fixing unit 13, the static eliminating device 21, the operation unit 47, the facsimile communication unit 71, and the network interface unit 91, and controls driving of each of the units.

The controller 100 determines conditions of the image forming apparatus 1 and whether it is necessary to eliminate the surface of the photosensitive body 121. In accordance with the determination result, as described in FIG. 4, the controller 100 determines which signal is to be applied to each of the bases of the transistors TR 1 and TR2, and applies each determined signals to the bases of the transistors TR1 and TR2 respectively.

FIG. 5 is a table showing relation among: states of the image forming apparatus 1; the signal applied to the base of the transistor TR2, which is HEATER-ON signal; the signal applied to the base of the transistor TR1, which is ERASER signal; and lighting states of the chip light emitting diodes D1 to D7.

When the image forming apparatus 1 is on a ready-to-print mode (printable condition) or in a printing mode (in printing), the controller 100 (FIG. 4) to be subsequently described switches the transistor TR1 to the ON state and switches the transistor TR2 to the OFF state. As a result, the HEATER-ON signal becomes the low signal. The ERASER signal becomes the high signal when the static elimination of the surface of the photosensitive body 121 is necessary, and becomes the low signal when the static elimination is unnecessary.

When the static elimination is necessary, the controller 100 (FIG. 4) switches the transistor TR1 to the ON state and switches the transistor TR2 to the OFF state. As a result, the HEATER-ON signal becomes the low signal, the ERASER signal becomes the high signal, and current flows to the chip resistors R1 to R6 and the chip light emitting diodes D1 to D7. Accordingly, the chip resistors R1 to R6 serve as the limiting resistor, and the chip light emitting diodes D1 to D 7 are lighted, thereby irradiating the light onto the surface of the photosensitive body 121.

In contrast, when the static elimination is unnecessary, the controller 100 (FIG. 4) switches the transistors TR1 and the transistor TR2 to the ON state. As a result, the HEATER-ON signal as well as the ERASER signal becomes the low signals, and no current flows to the chip resistors R1 to R6 and the chip light emitting diodes D1 to D7. Accordingly, lighting of the chip light emitting diodes D1 to D7 is off, so that the light is not irradiated onto the surface of the photosensitive body 121.

When the image forming apparatus 1 is on an off-mode or on a sleep mode (low power state), the controller 100 (FIG. 4) switches the transistor TR1 to the OFF state and switches the transistor TR2 to the ON state. As a result, the HEATER-ON signal becomes the high signal and the ERASER signal becomes the low signal, and current flows to the chip resistors R1 to R6, but not to the chip light emitting diodes D1 to D7. Accordingly, the chip resistors R1 to R6 generate heat, thereby the surface of the photosensitive body 121 is warmed and dehumidified, but chip light emitting diodes D1 to D7 are not lighted.

In the present embodiment, by controlling the ON/OFF operations of the transistor TR2, the chip resistors R1 to R6 can generate heat, without the chip light emitting diodes D1 to D7 being lighted. Therefore, shortening the life of the photosensitive body 121 is prevented because light is not emitted onto the surface of the photosensitive body 121 by the chip light emitting diodes D1 to D7 in the dehumidification of the surface of the photosensitive body 121.

In addition, the substrate 22 provided with the chip light emitting diodes D1 to D7 and the chip resistors R1 to R6 serves roles of a conventional substrate for the static elimination, which having been already included in the image forming apparatus 1, so that new space to arrange the substrate 22 is not required. Thus, space saving can be achieved. Furthermore, the chip resistors R1 to R6 serving as heater elements for dehumidification are also used as limiting resistors. Thus, cost-down can also be achieved.

For example, as a conventional configuration for preventing a surface of a photosensitive body from dew condensation, there is a known technique for warming a surface of the photosensitive body by a heater for dehumidification. However, as a cost of heaters is not low, there have been problems such as increase in costs, or securing enough space to arrange heaters.

Also known technique is to simply warming a photosensitive body by a heater element attached to back of an LED substrate that eliminates the photosensitive body. In this technique, however, because the heater element generates heat at the other side of a surface of the photosensitive body, only small heating effect can be obtained. Moreover, when the heater element generates heat, an LED is turned on, thereby irradiating light onto the surface of the photosensitive body even when the static elimination is unnecessary, which result in shortening the life of the photosensitive body. What is more, the life of the LED is also shortened.

In addition, a technique to prevent dew condensation from surrounding of a document reading position with simply heating an LED has been known. It may be possible to prevent dew condensation from a surface of a photosensitive body by applying this technique to dehumanize the surface of the photosensitive body. However, like aforesaid known technique, this technique irradiates light onto the surface of the photosensitive body even when the static elimination is unnecessary, which result in shortening the life of the photosensitive body.

In contrast, the configuration according to the foregoing embodiment enables dehumanization of the surface of the photosensitive body while saving space and decreasing the cost without shortening the life of the photosensitive body.

The present disclosure should not be limited to the configurations described in the embodiment but various modifications are applicable. Although the description of the above embodiment is given taking a multifunction peripheral, as an example of the image forming apparatus according to the present disclosure, the example is merely illustrative and the image forming apparatus may be any other electronic apparatuses, including other image forming apparatus having, for example, copying, facsimile, and printing functions.

It is to be understood that the configurations and operations described in the foregoing embodiment with reference to FIG. 1 to FIG. 5 are merely exemplary, and in no way intended to limit the configuration and operation of the present disclosure.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A static eliminating device comprising a substrate provided with a light emitter and a limiting resistor, the light emitter being arranged at an opposing position of a surface of a photosensitive body and irradiating static eliminating light for eliminating the surface of the photosensitive body, the limiting resistor for the light emitter being provided on a same surface as the light emitter, wherein one end of the light emitter is connected to a power source via the limiting resistor, the static eliminating device further comprising:

a first switching section provided at a position from the limiting resistor and the light emitter, which are connected in series, to the power source, the first switching section connecting the power source to the limiting resistor and the light emitter at an ON state, and disconnecting the power source from the limiting resistor and the light emitter at an OFF state;

a second switching section provided at a position from the limiting resistor to the power source, which are connected in series, the second switching section connecting the power source to the limiting resistor at the ON state, and disconnecting the power source from the limiting resistor at the OFF state; and a controller controlling ON/OFF operations of the first and the second switching sections, wherein the light emitter is branched from a position between the limiting resistor and the power source connected in series, and is serially connected to the limiting resistor, the first switching section is provided at a position from the light emitter and the power source, when driving the light emitter, the controller switches the first switching section to the ON state and switches the second switching section to the OFF state, and when heating the surface of the photosensitive body, the controller switches the first switching section to the OFF state and switches the second switching section to the ON state.

2. The static eliminating device according to claim 1 further comprising a plurality of the limiting resistors connected to each other in series, wherein on the substrate extending in a longitudinal direction of the photosensitive body, the plurality of limiting resistors are disposed on the substrate equally in the longitudinal direction.

3. The static eliminating device according to claim 1 further comprising a plurality of the light emitters connected to each other in series, wherein on the substrate extending in a longitudinal direction of the photosensitive body, the plurality of light emitters are disposed on the substrate equally in the longitudinal direction.

4. An image forming apparatus comprising:

an image forming unit including the photosensitive body; and the static eliminating device according to claim 1.

5. The image forming apparatus according to claim 4, wherein the image forming apparatus operates in each modes, that are: a ready-to-print mode standing by in a printable manner; a printing mode that operates printing; an off mode being in a power off state; and a sleep mode being in a low power state, in a case where the image forming apparatus is in the ready-to-print mode or in the printing mode, when eliminating the surface of the photosensitive body, the controller performs a switching so as to switch the first switching section to the ON state and switch the second switching section to the OFF state, and when heating the surface of the photosensitive body, the controller performs a switching so as to switch the first switching section to the OFF state and switch the second switching section to the ON state, and in a case where the image forming apparatus is in the off mode or in the sleep mode, the controller switches the first switching section to the OFF state and switches the second switching section to the ON state.

* * * * *